United States Patent [19]

Grivna

[11] 4,038,784

[45] Aug. 2, 1977

[54] METHOD AND APPARATUS FOR CROSS GRAIN ABRADING TO PRODUCE A ROUGH-SAWN EFFECT

[75] Inventor: Howard W. Grivna, Fridley, Minn.

[73] Assignee: Acrometal Products, Inc., Minneapolis, Minn.

[21] Appl. No.: 684,010

[22] Filed: May 7, 1976

[51] Int. Cl.[2] ..... B24B 1/00; B24B 21/08

[52] U.S. Cl. ..... 51/139; 51/141; 51/328; 144/309 A

[58] Field of Search ..... 51/137–139, 51/141, 135 R, 328; 144/309 A

[56] References Cited

U.S. PATENT DOCUMENTS

| | | | |
|---|---|---|---|
| 1,978,149 | 10/1934 | Stevenson | 51/139 |
| 2,762,173 | 9/1956 | Bottcher | 51/138 X |
| 3,049,839 | 8/1962 | Smith | 51/141 |
| 3,124,909 | 3/1964 | Nylund | 51/141 |
| 3,408,775 | 11/1968 | Rutt | 51/141 X |
| 3,570,568 | 3/1971 | Kneisel | 144/309 A |
| 3,633,319 | 1/1972 | Maag | 51/139 |
| 3,686,798 | 8/1972 | Copresti | 51/138 |
| 3,782,044 | 1/1974 | Olin | 51/138 |

FOREIGN PATENT DOCUMENTS

| | | | |
|---|---|---|---|
| 924,256 | 2/1955 | Germany | 51/138 |
| 1,232,226 | 5/1971 | United Kingdom | 51/137 |

*Primary Examiner*—Harold D. Whitehead
*Assistant Examiner*—Nicholas P. Godici
*Attorney, Agent, or Firm*—Merchant, Gould, Smith, Edell, Welter & Schmidt

[57] ABSTRACT

Apparatus for cross abrading a workpiece of wood or the like to create a rough-sawn effect across the grain of the wood. The apparatus employs a continuously operating endless abrasive belt that moves relative to a predetermined work area. The workpiece is moved through the work area by a plurality of drive and press rollers generally perpendicularly to the line of endless belt movement. To preclude the abraded rough-sawn effect from being oblique on the workpiece surface, the apparatus includes an oblique platen having a narrow land surface that causes the endless abrasive belt to engage the workpiece over a narrow region of contact. The obliqueness of the platen limits the effect of any given abrasive particle to the narrow region of contact, thus creating cross abrading which is generally perpendiular to the line of workpiece movement.

25 Claims, 12 Drawing Figures

METHOD AND APPARATUS FOR CROSS GRAIN ABRADING TO PRODUCE A ROUGH-SAWN EFFECT

The invention is directed to apparatus for creating a rough-sawn effect in material such as wood.

Building materials having a rough, cross-sawn appearance are used frequently for decorative as well as functional purposes in many structures, including residential and commercial, both in interiors and exteriors. The rough-sawn effect is architecturally pleasing, long wearing and often requires lesser maintenance than its smooth surfaced counterparts.

The effect is ordinarily created during the rough dimensioning of lumber. For purposes of faster cutting of speeds and maintaining saw sharpness, rough cuts are usually made with saw blades having substantial "set" in their teeth; i.e., alternating teeth of the blade project laterally to each side out of the plane of the blade. Wood is more efficiently cut across the grain rather than with the grain. Thus, as the blade moves through the wood and across its grain, the offset teeth leave channels or scratches in the remaining surface, and the overall effect is a rough surface.

Although some wood may be used in a rough dimension form, most of it must be "dressed down" to uniform dimensions of closer tolerance. However, such dimensioning of lumber is usually accomplished with machinery (e.g., a planing mill) which leaves a smooth surface. Consequently, in order for dimension lumber, planking or the like to have a rough-sawn effect, it must be created after the wood has been finally dimensioned. The same holds true for plywood and other fabricated forms of wood.

Various approaches have been taken to obtain the cross-sawn effect in dimensioned lumber, planking and fabricated wood forms. For example, bandsaws have been mounted to operate across lumber as it is moved longitudinally. However, lumber cannot be moved with any degree of speed with such an arrangement, and the results are also less satisfactory.

Another approach has utilized a rotating cylindrical drum to which a replaceable abrasive sleeve is secured. U.S. Pat. No. 3,339,319, which is entitled "Abrasive Sleeve for Rotary Abrading Machines" and issued on Sept. 5, 1967, and in which I am a co-inventor, is directed to an abrasive sleeve used for such a purpose. In using the device, the workpiece is positioned with its longitudinal dimension in parallel relation to the rotational axis of the drum, and the workpiece is moved laterally into abrasive engagement with the drum while maintaining the parallel relationship.

One of the disadvantages with such a machine is the fact that the abrasive drum is capable of operating only on workpieces having a length equal to or less than its own length. The upper practical limit on the length of such abrasive drums is about 10 feet, and workpieces of greater length must pass through the machine more than once if successive passes are possible at all. Another significant difficulty with this arrangement is the difficulty in replacing the cylindrical abrasive sleeve on the drum. The sleeves are shrunk fit to the drum; and the longer the drum, the greater the difficulty in replacing the sleeve. Thus, the system either requires considerable downtime for sleeve replacement, or that a spare drum and new sleeve be maintained on hand at all times.

I am also aware of the use of an endless rubber belt having large abrasive pices which are dragged across the surface of a workpiece as it moves longitudinally. With a system of this type, sawdust accumulates across the width of the belt and moves with the belt over the workpiece surface, thus preventing the abrasive pieces from having the proper effect over the full width of the workpiece. Another inherent disadvantage with such an arrangement is the relatively slow production rate. If the longitudinal speed of the workpiece is increased, the resulting effect of a given abrasive particle relative to the wood surface becomes diagonal or oblique rather than straight across, and the resulting effect is undesirable.

The subject invention is the result of an endeavor to create a machine capable of producing a satisfactory cross-grained, rough-sawn effect in workpieces of various size on a continuous basis.

Continuous operation is best achieved by continuously moving the workpiece longitudinally relative to a continuously operating endless belt which moves across the grain of the wood. However, as pointed out above with regard to prior art machines, provisions must be made to prevent the accumulation of sawdust between the belt and the workpiece surface, and also to preclude the oblique or diagonal formation of grooves due to longitudinal speed of the workpiece.

I have discovered that the inclusion of an obliquely disposed longitudinal platen over which the abrasive belt slides, and which has a relatively narrow bearing surface exerting force through the abrasive belt to the workpiece surface, achieves extremely satisfactory results. More specifically, the platen is obliquely disposed with respect to the line of movement of the abrasive belt, as well as to the line of movement of the workpiece. The bearing surface of the platen (which acts on the backside of the endless belt) is relatively narrow as pointed out above, and may take the form of a land surface or of a single line of contact.

The use of an oblique platen gives initial but momentary effect to the abrasive particles on the leading side of the endless belt relative to a given incremental transverse section of the board. Because the bearing contact of a particular abrasive particle is momentary, the result is a short groove which is generally perpendicular to the line of board movement. As the incremental transverse section proceeds, abrasive particles which are laterally spaced from the leading side of the belt act through an obliquely spaced region of the platen so that an adjacent region of the incremental section is grooved. This process continues until the entire incremental transverse section of the workpiece has passed through the influence of the oblique platen, resulting in a plurality of relatively short but aligned grooves lying generally parallel of the line of abrasive belt movement, and generally perpendicularly of the line of longitudinal workpiece. It will be evidence from an extension of the this example to all regions of the workpiece passing relative to the abrasive belt and platen that the cross-sawn effect is given to the entire workpiece surface.

By reason of the extremely limited bearing exposure of a given abrasive particle to the board surface, it will also be appreciated that a buildup of sanding dust or sawdust to the point of interfering with creation of the cross-sawn effect is virtually eliminated. Other inherent advantages in the arrangement are the capability of continuously running all workpieces in the normal (longitudinal) production direction of travel, and the capability of easily producing the effect in workpiees of varying width, including plywood.

DESCRIPTION OF THE PREFERRED EMBODIMENTS

Figure 1:
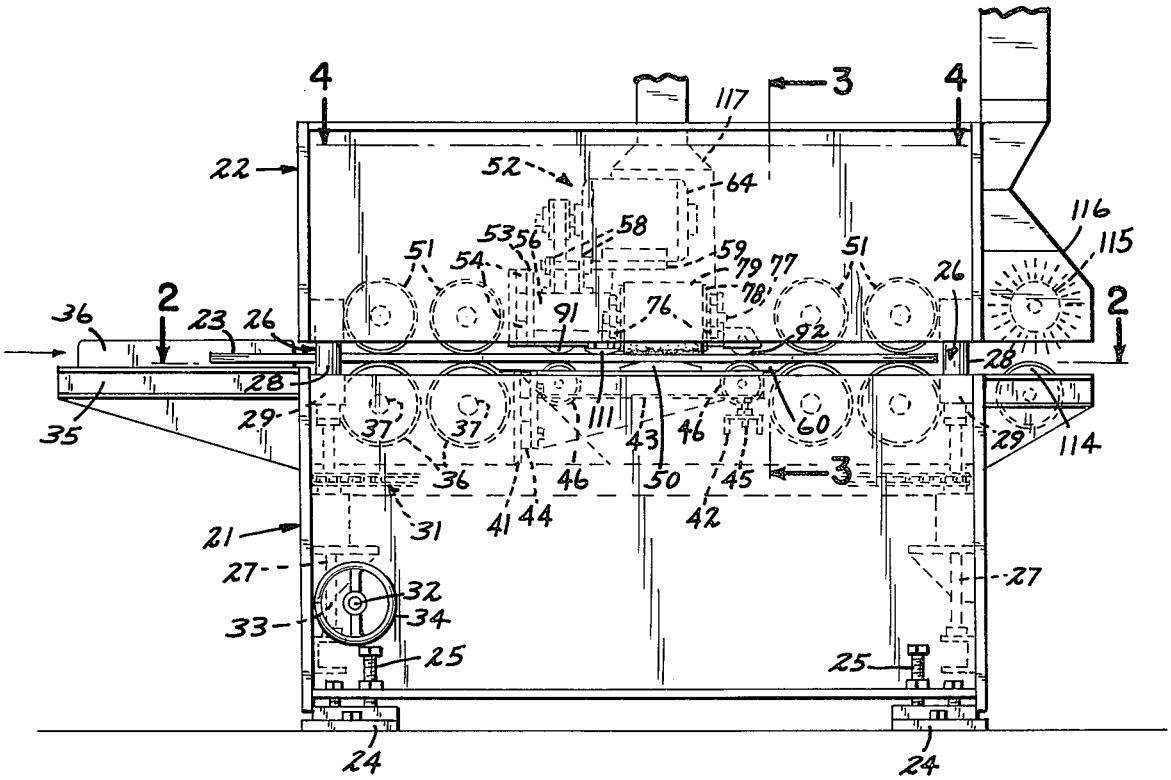
FIG. 1 is a view in side elevation of a machine embodying the inventive principle, the machine having a stationary base and a vertically adjustable head.
Figure 2:
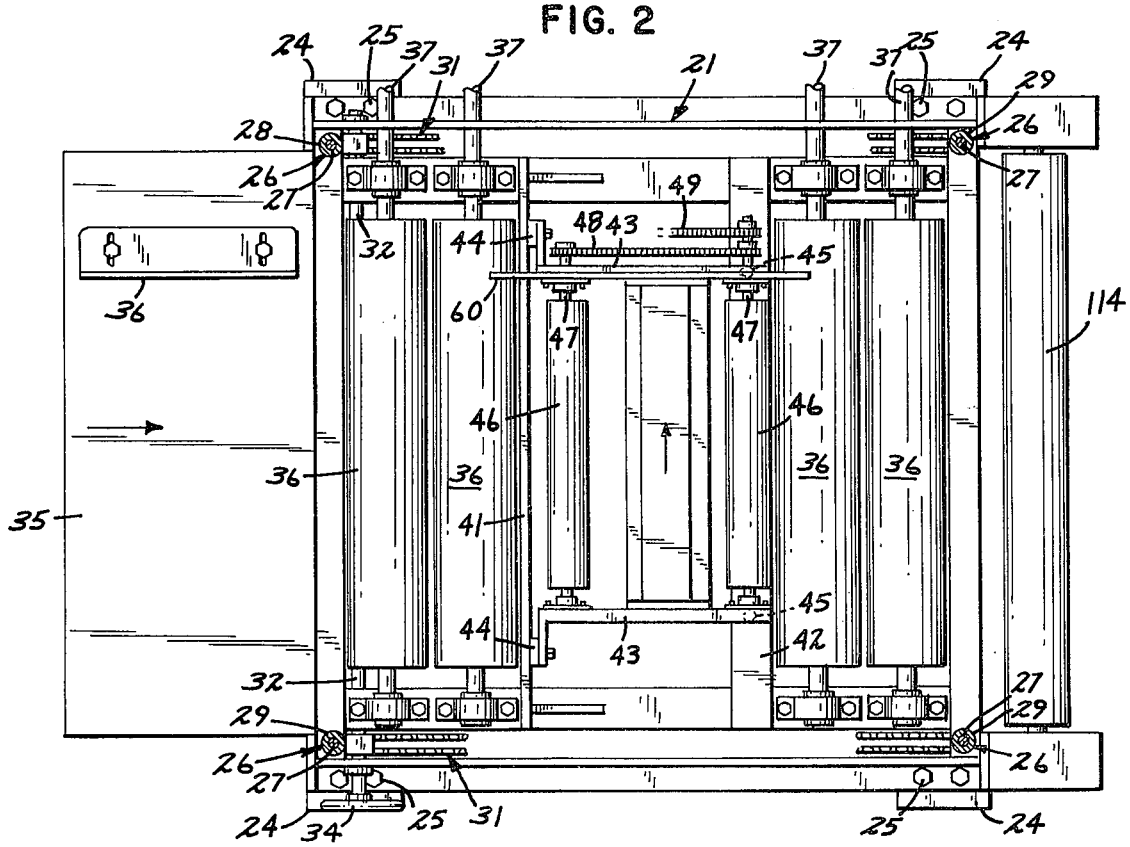
FIG. 2 is a sectional view of the machine taken along the line 22 of FIG. 1, showing the stationary base in top plan.

With initial reference to FIGS. 1 and 2, a cross-grain sanding machine embodying the inventive concept is shown to broadly comprise a stationary base 21 and a vertically movable head 22 between which a workpiece 23 moves (from left to right in these Figures). Base 21 comprises a rectangular framed cabinet which is bolted to a floor through mounting pads 24. Adjustment bolts 25 mounted relative to the mounting pads permit leveling of the base 21.

Head 22 also comprises a rectangular framed cabinet somewhat smaller in overall size than base 21, but being of essentially the same length and width. With additional reference to FIG. 3, head 22 is vertically adjustable relative to base 21 through the influence of four corner jacks 26. Each of the jacks 26 consists of an externally threaded rotatable shaft 27 that operates in conjunction with an internally threaded cylinder 28. The threaded cylinders 28 are affixed to the internal frame of head 22 at each corner, but slide relative to a stationary sleeve 29 secured to the internal frame work of base 21. Thus, rotational movement of the shaft 27 in either direction will effect raising and lowering movement of its associated corner of the head 22.

Synchronized operation of longitudinally aligned jack pairs is by a chain-sprocket arrangement shown generally at 31 in FIGS. 1 and 2. Overall synchronized operation is accomplished by a worm shaft 32 which extends transversely of the base 21 and is journaled in each of its sides. Rotation of the worm shaft 32 simultaneously rotates a pair of pinion gears 33 (one of which is shown) which are respectively mounted on the adjscent shafts 27. The worm shaft 32 is rotated by a handle wheel 34 which is disposed outside the base cabinet.

Entry of the workpiece 23 into the machine is facilitated by an extension table 35 which is mounted on and projects from base 21. Extension table 35 includes a laterally adjustable fence 36.

With continued reference to FIGS. 1 and 2, base 21 further includes four drive rollers 36 which are arranged in pairs on the inlet and outlet and of the apparatus. Each of the drive rollers 36 is mounted for rotation with a shaft 37, and each shaft 37 is journaled in a pair of bearings 38 mounted on opposite sides of the base framework. As shown in FIG. 2, the axes of rotation of the drive rollers 36 are commonly parallel, and perpendicular to the intended line of workpiece movement. The drive shafts 37 are synchronously driven at the same rotational velocity by means not shown.

Figure 3:
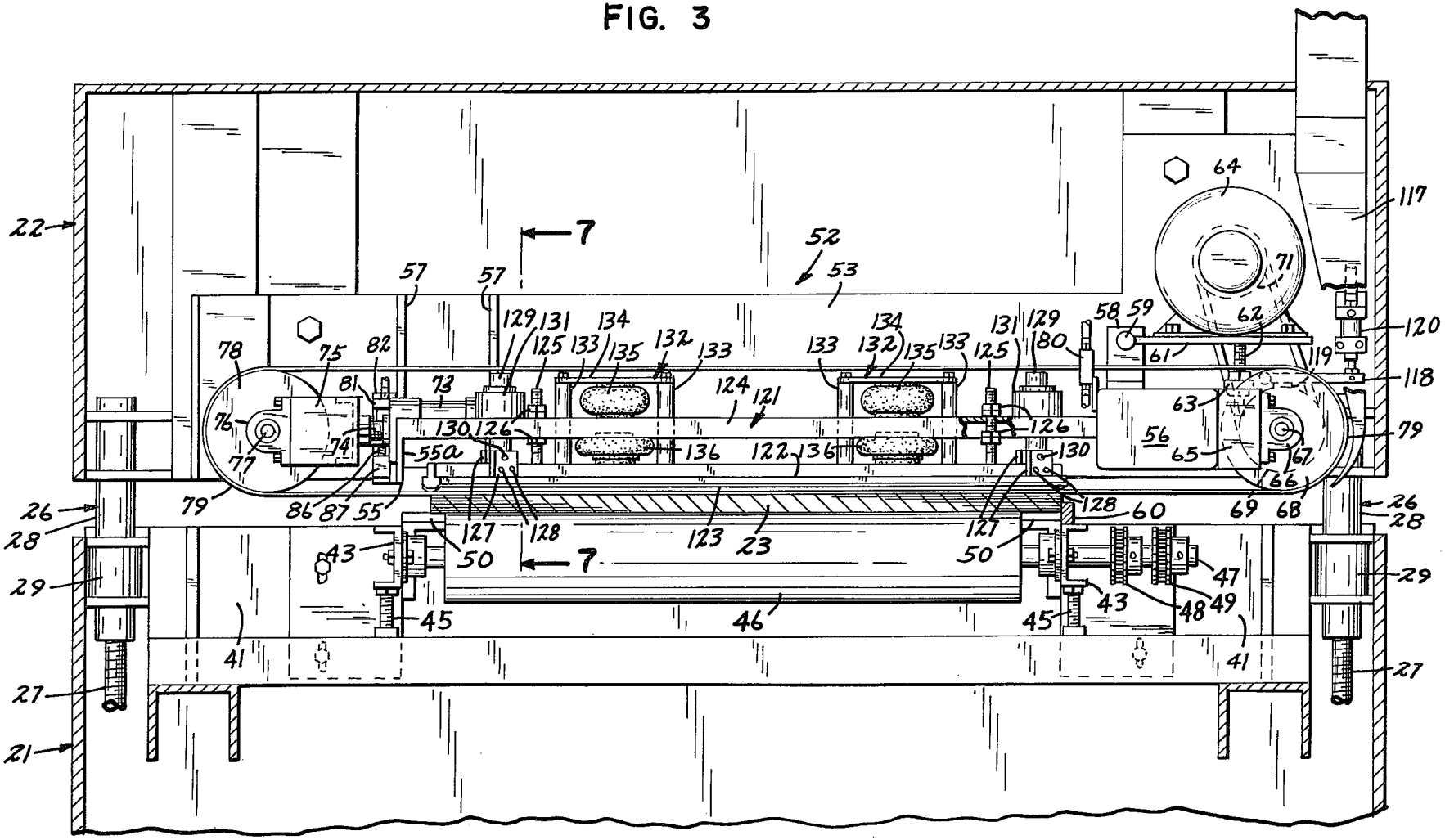
FIG. 3 is an enlarged sectional view taken along the line 33 of FIG. 1, showing in particular the endless abrasive belt and oblique platen in side elevation portions being removed.

With continued reference to FIGS. 1 and 2, a rectangular plate 41 is transversely mounted on edge between opposite sides of the base framework just beyond the first pair of drive rollers 36. Slightly forward of the second pair of drive rollers 36, a channel member 42 is also transversely mounted between opposite sides of the base framework. The plate 41 and member 42 together carry a pair of L-shaped supports 43 which are disposed in parallel relation, each being spaced inwardly from the side of base 21. The short leg of each of the supports 43 is bolted to the rectangular plate 41 through spacers 44 (FIGS. 1 and 2). As best shown in FIG. 3, the long leg of each support 43 is channeled in cross section, and the end overlying the channel member 42 rests on an adjustment bolt 45 carried by the channel member 42. As such, the L-shaped supports 43 are capable of leveling adjustment.

A stationary fence 60 is secured to the top of one of the L-shaped supports 43 in longitudinal alignment with the fence 35 to guide movement of the workpiece 23 as it passes through the cross-abrading area.

Journaled between the supports 43 are a pair of smaller drive rollers 46 having drive shafts 47. As best shown in FIG. 2, the drive shafts 47 are simultaneously driven by a chain-sprocket arrangement 48, with the rearmost roller 46 driven through a chain and sprocket 49 by means not shown.

With reference to FIGS. 1 and 2, a stationary backing foot or platen 50 is mounted laterally between the L-shaped supports 43 and longitudinally between the drive rollers 46. The upper surface of foot 50 is flat and disposed in a plane with the top of drive rollers 46 to provide backing support during the cross-abrading operation as described below.

Head 22 includes four press rollers 51 journaled between its framework sides in opposed relation to the respective drive rollers 36. Press rollers 51 are idlers rather than driven; and upon proper vertical adjustment of the head 22 relative to the base 21, press rollers 51 cooperate with the drive rollers 36 to advance the workpiece 23 through the proper line of movement while at the same time holding it both vertically and laterally for the cross-abrading operation described below.

Figures 4, 5, 6, 7:
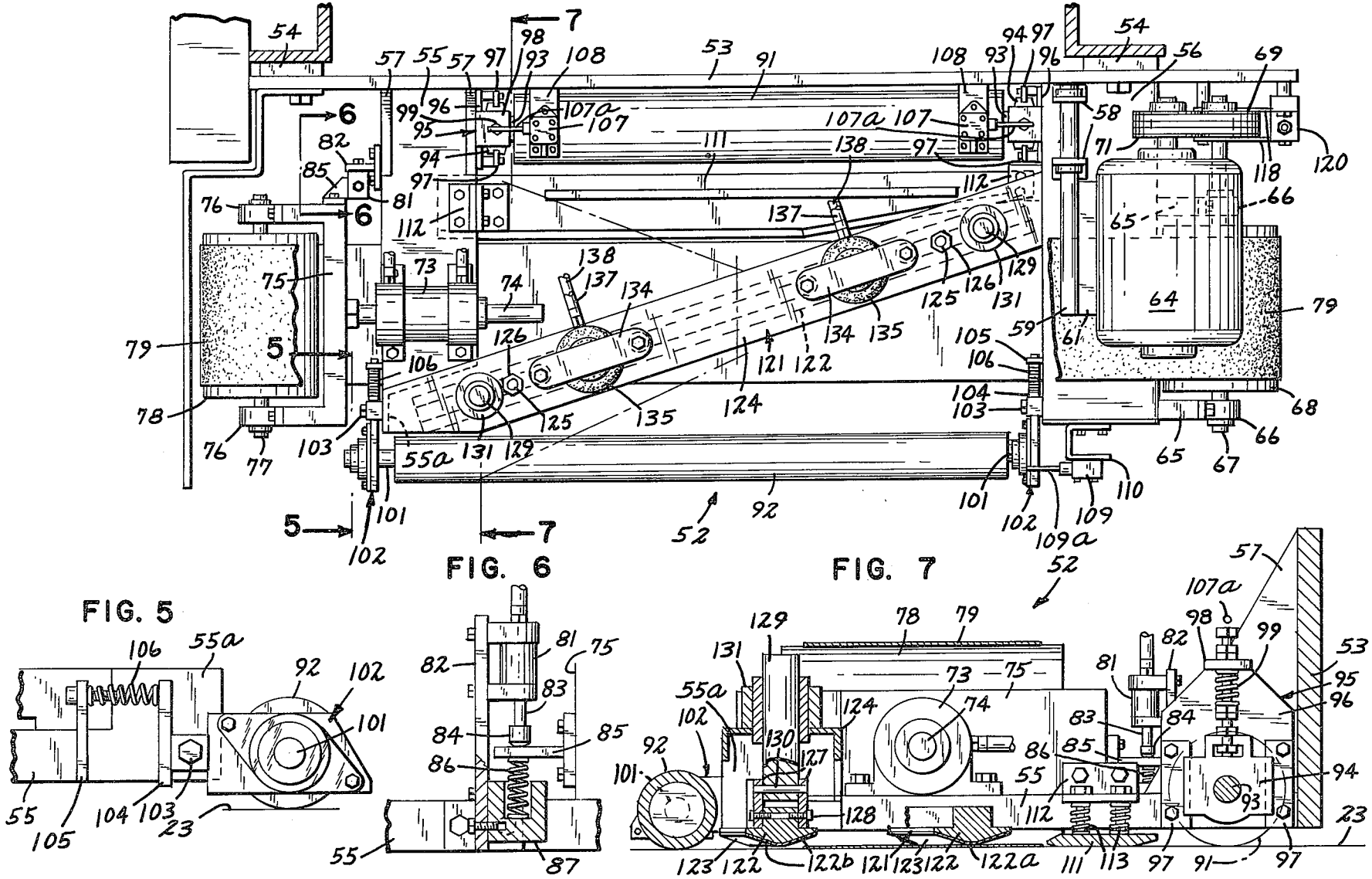
FIG. 4 is an enlarged fragmentary sectional view taken along the line 44 of FIG. 1, showing in particular the endless abrasive belt and oblique platen relative to the workpiece and workpiece drive apparatus in top plan.
FIG. 5 is an enlarged fragmentary section view taken along the line 55 of FIG. 4.
FIG. 6 is an enlarged fragmentary sectional view taken along the line 66 of FIG. 4.
FIG. 7 is an enlarged fragmentary sectional view taken along the line 77 of FIG. 4.

With reference to FIG. 1, a cross-abrading assembly is represented generally by the numeral 52. With additional reference to FIG. 3, and 4, an L-shaped plate 53 is bolted to opposite sides of the framework of head 22 through spacers 54. As shown, plate 53 is disposed perpendicularly to the line of workpiece movement, and carries a pair of cantilevered arms 55, 56 which are disposed longitudinally of the line of the workpiece movement. As best shown in FIGS. 3, 4 and 7, cantilevered arm 55 is a channel member, extending from the lower face of plate 53; and its cantilevered position is strengthened by a pair of triangular gussets 57 secured to the plate 53.

With reference to FIGS. 3 and 4, cantilevered arm 56 consists of a rectangular tube secured to the face of plate 53, which its horizontal supporting surface spaced above that of cantilevered arm 55.

Support of the motor drive for cross-abrading assembly 52 is shown in FIGS. 3 and 4. A pair of vertical, L-shaped legs 58 are secured to the horizontal supporting surface of the cantilevered arm 56. A horizontal shaft 59 is journaled for rotation in the legs 58. One edge of a rectangular plate 61 is secured to the shaft 59 for rotation therewith, and an adjustment bolt 62 projecting downwardly from the plate 61 is locked to a bolt support 63 by a pair of lock nuts so that plate 61 is horizontal. The motor 64 is bolted to plate 61.

The support 63 is mounted to one of two spacer supports 65, each of which is secured to the side of cantilevered arm 56. A bearing 66 is in turn secured to each of the spacer supports 65 to rotatably carry a shaft 67. A cylindrical drum 68 is mounted on shaft 67 for rotation therewith.

As best seen in FIG. 4, shaft 57 projects well beyond one of the bearings 66 and carries a drive pulley 69. A similar drive pulley 71 is mounted on the drive shaft of motor 64, and a plurality of V-belts connect the two to drive cylindrical drum 68.

At the oppose side of level 22, a pneumatic cylinder 73 is mounted on cantilevered arm 55. Pneumatic cylinder 73 has an axially movable output shaft 74 connected to a yoke 75, which is also capable of rotation about its longitudinal axis. A pair of bearings 76 are carried by the yoke 75 in opposed relation, and rotatably carry shaft 77 of an idling cyclindrical drum 78.

As shown in FIGS. 3 and 4, drum 78 is aligned with drum 68, and an abrasive endless belt 79 is mounted over the two. Proper belt tension is accomplished through the application of pressure to pneumatic cylinder 73, which pushes the yoke 75 and drum 78.

Abrasive belt 79 has a heavy backing fabric, and its abrading surface consists of very coarse grit, such as No. 4 or No. 6 aluminium oxide, which is sparsely distributed over the belt surface.

A sensor 80 positioned at one edge of belt 79 determines whether the lateral position of the abrasive belt 79 is proper. With reference to FIGS. 4 and 6, an improper later position of the belt 79 is corrected by a pneumatic motor 81. Motor 81 is carried by a support 82 which is mounted to the side of cantilevered arm 55. Motor 81 has an axially movable output shaft 83, and a bumper 84 is secured to its end.

A tracking member 85 is mounted on the yoke 75 so that its top surface is engaged by the bumper 84. A coil spring 86 acting between the underside of tracking member 85 and a spring receptacle 87 (which is carried by the support 82) normally biases the tracking member 85 upwardly. It will be appreciated that application of pressure to the pneumatic motor 81 will effect a twisting movement to the yoke 75 and drum 78, which controls the lateral position of belt 79 relative to sensor 80.

With reference to FIGS. 1, 4 and 7, the cross-abrading assembly 52 further comprises a pair of press rollers 91, 92, which are respectively aligned and cooperate with the drive rollers 46 to properly drive and guide the workpiece 23 relative to the cross-abrading area. Press rollers 91, 92 are both spring biased downwardly or toward the workpiece, the biasing mechanism being somewhat different for each roller.

Press rollers 91, 92, as well as press rollers 51 and drive rollers 36, 46, are preferably covered with a thin layer of resilient material to permit marring of the workpiece surface.

With reference to FIGS. 4 and 7, press roller 91 has a shaft 93 at each of its ends, each shaft 93 being rotatably carried by a bearing block 94. Bearing block 94 is vertically slideable relative to a bearing block support, which is represented generally by the numeral 95. The support 95 consists of a backing plate 96 to which a pair of vertically disposed slide rails 97 are secured. The sides of bearing block 94 are vertically grooved to receive the slide rails 97 for the aforesaid vertical sliding movement.

The backing plates 96 are respectively mounted on the cantilevered arms 55, 56. Each of the plates 96 has a horizontal tab 98 which carries an adjustable coil spring-bolt assembly 99 (FIG. 7). The lower end of the assembly 99 is secured to the bearing block 94 and adjusted to exert a downward biasing force on the press roller 91 as the workpiece moves through the cross-abrading area.

With reference to FIGS. 4 and 5, press roller 92 also includes a pair of end shafts 101 which are respectively journaled in a pair of end bracket assemblies 102. Each of the bracket assemblies 102 is pivotally mounted to its associated cantilevered arm 55, 56 by a bolt 103. Bracket assembly 102 further includes a vertical plate 104 that is spaced from a similar vertical plate 105, the latter being secured to its associated cantilevered arm 55, 56. A coil spring-bolt assembly 106 is disposed between the plates 104, 105 to exert a downward biasing force on the press roller 92 as the workpiece moves through the abrading sanding area.

With reference to FIGS. 4 and 7, a spring loaded foot 111 is mounted between the cantilevered arms 55, 56 with its bottom surface in the same horizontal plane as the bottom of press rollers 91, 92. The leading and trailing edges of the foot 111 are tapered (FIG. 7) to prevent delamination of the workpiece, as will be described in further detail below. A pair of brackets 112 are respectively mounted to the cantilevered arms 55, 56 and the foot 111 is suspended from the brackets 112 through adjustable coil spring-bolt assemblies 113. As described, the foot 111 is biased downwardly as the workpiece 23 moves through the cross-abrading area.

As shown in FIG. 7, the cross-sectional shape of platen 122 is generally an inverted T. Projecting from the top surface of platen 122 are a pair of bolts 125 (FIG. 3) which extend through openings on the channel member 124 for sliding movement relative thereto. Lock nuts 126 above and below the channel mamber 124 serve as upper and lower stops to vertical movement of the platen 122.

A pair of vertical support plates 127 are secured to the sides of platen 122 by bolts 128 proximate each of its ends. A vertically disposed cylindrical guide 129 is pivotally connected between each pair of support plates 127 by a pin 130. The cylindrical guides 129 extend through openings formed through the channel member 124 and slide relative to stationary bearing collars 131. The cylindrical guides 129 effect smooth, guided vertical movement of the platen 122, and the pivotal connection between the platen 122 and each guide 129 gives some leeway to movement without binding either of the guides 129.

As shown in FIG. 7, spring-loaded foot 111 is mounted just ahead of the abrasive belt 79 from the standpoint of workpiece movement. Its purpose is to engage the upper surface of the workpiece and exert a strong downward force on any splinter or delamination in the grain of the workpiece. As such, the splinter or delamination is forced under the abrasive belt 79. In the absence of the spring-loaded foot 11, it is possible for the splinter or delamination to ride up and over the abrasive belt 79, and the belt thereafter acts in sawing fashion to further the split and ruin the workpiece.

A platen assembly is represented generally by the numeral 121 in FIGS. 3, 4 and 7. The assembly 121 includes a platen 122 which is obliquely disposed relative to the movement of abrasive belt 79 as well as to the line of movement of workpiece 23. The platen assembly 121 suspends and biases the platen 122 downwardly into engagement with the back side of abrasive belt 79 and influences its abrading effect on the workpiece 23 as described in further detail below. A low friction fabric cover 123 impregnated with graphite or the like is preferably secured to the lower surface of platen 122 to reduce friction with the abrasive belt 79 as it moves by.

The primary support for platen 122 is a channel member 124 which is obliquely secured to the cantilevered arms 55, 56. As particularly shown in FIGS. 4 and 5, cantilevered arm 55 includes a vertical extension plate 55*a* which abuts and is secured to the end of channel member 124 for additional rigidity and strength.

As shown in FIG. 7, the cross-sectional shape of platen 122 is generally an inverted T. Projecting from the top surface of platen 122 are a pair of bolts 125 (FIG. 3) which extend through openings on the channel member 124 for sliding movement relative thereto. Lock nuts 126 above and below the channel member 124 serve as upper and lower stops to vertical movement of the platen 122.

A pair of vertical support plates 127 are secured to the sides of platen 122 by bolts 128 proximate each of its ends. A vertically disposed cylindrical guide 129 is pivotally connected between each pair of support plates 127 by a pin 130. The cylindrical guides 129 extend through openings formed through the channel member 124 and slide relative to stationary bearing collars 131. The cylindrical guides 129 effect smooth, guided vertical movement of the platen 122, and the pivotal connection between the platen 122 and each guide 129 gives some leeway to movement without binding either of the guides 129.

Vertical positioning of the platen 122 is afforded through a pair of pneumatic adjustment mechanisms 132. Each mechanism 132 consists of a pair of tubular guides 133 which are bolted to the top of platen 122 and are slideably received through openings in the channel member 124. The upper ends of guides 133 are interconnected by a support plate 134. An air bag 135 is mounted between support plate 134 and the top surface of channel member 124, and a similar air bag 136 is mounted between the upper surface of platen 122 and the undersurface of channel member 124.

As described, the pneumatic adjustment mechanism 132 and platen 122 are capable of vertical movement relative to the stationary oblique channel member 124, and the desired vertical position is determined by application of appropriate pressure to the air bags 135, 136 through air inlets 137, 138, respectively. Being resilient, the air bags 135, 136 also permit a degree of yielding movement of the platen 122 as the workpiece 123 moves through the cross-grain abrading area.

With reference to FIG. 4, a sensor switch 107 is mounted by a bracket 108 to plate 53 proximate each end of the press roller 91. Each of the sensor switches 107 has a sensing arm 107*a* which projects laterally into engagement with the spring-loaded bolt of the assembly 99 (FIG. 7). As the workpiece 23 engages the press roller 91 and drives it wupward, at least one of the sensor arms 107*a* is also driven upward to actuate its associated sensor switch 107. The platen 122 is normally in a vertically retracted position through the control of pressure to the air bags 135, 136. The sensor switches 107 are connected in parallel in a control circuit (not shown), and actuation of either causes the platen 122 to be lowered to its operational position by controlling the pressure to air bags 135, 136.

A similar sensor switch 109 is mounted by a bracket 110 to the end of cantilevered arm 56. Switch 109 has a sensing arm 109*a* which senses the vertical position of press roller 92. Its connection in the control circuit causes the platen 122 to be vertically retracted as the workpiece 23 moves out of the cross-abrading area and the press roller 92 moves downward under the bias of springs 106.

At the outlet side of the base 21, an idler roller 114 is journaled between opposite sides of the base framework in alignment with and in the same operational plane as the drive rollers 36, 46. A brush roller 115 is rotatably mounted in the side framework of head 22 in vertical opposition to the roller 114. As viewed in FIG. 1, brush roller 115 is driven in a clockwise direction to brush dust from the workpiece surface.

As shown in FIG. 1, brush roller 115 is disposed within a dust collecting hood 116 which forms the lower end of a vacuum duct. Similarly, and with reference to FIG. 3, a dust collecting hood 117 defining the terminal end of a similar vacuum duct is mounted relative to the abrasive belt 79 as it passes around drum 68.

With reference to FIGS. 3 and 4, a brake to slow movement of the abrasive belt is shown to comprise a pivotally mounted arm 118 to which a brake shoe 119 is secured for braking engagement with the drive pulley of cylindrical drum 68. Braking pressure is provided by a pneumatic cylinder 120 the output shaft of which engages the pivot arm 118.

Figure 8:
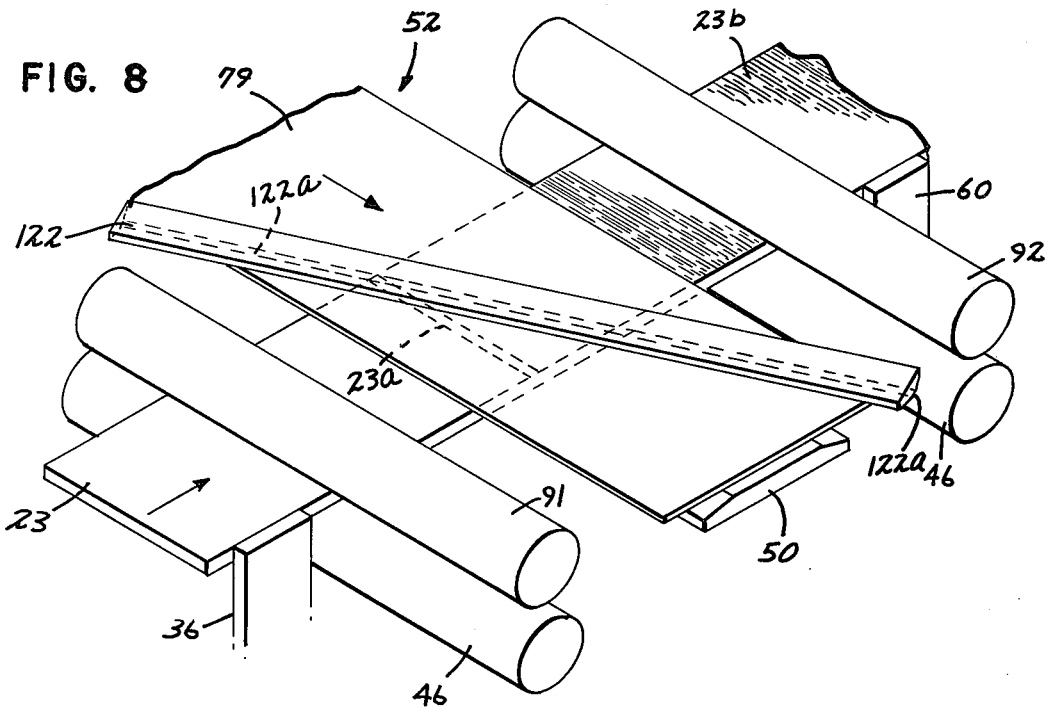
FIG. 8 is a perspective representation of the more essential elements of the inventive apparatus.

Operation of the overall apparatus is best understood by reference to the simplified perspective representation of FIG. 8. In FIG. 8, the workpiece 23 is shown as a $1 \times 12$ having longitudinal grain which is not shown. The workpiece 23 is moved through the cross-grain sanding area by drive rollers 46 acting in cooperation with spring loaded press rollers 91, 92. The workpiece 23 is aligned as it moves through the sanding area by the fences 36, 60. As will be noted, the direction of movement of abrasive belt 79 urges the workpiece into lateral contact with the fences 36, 60.

Workpiece 23 is moved over the backing platen 50, which underlies the abrasive belt 79. Platen 122 is biased downward into engagement with the back side of abrasive belt 79, and the region of abrading activity on the workpiece 23 is intensified at the region of contact of the platen on the abrasive belt 79.

Figure 9:
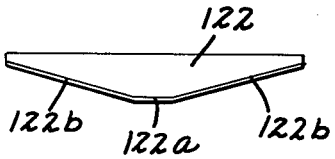
FIG. 9 is an enlarged end elevation of the platen.

FIG. 9 is a cross-sectional representation of the platen 122 which has a relatively narrow land or contact region 122*a,* lying in a plane essentially parallel with the workpiece surface. Sides 122*b* of the platen 122 diverge upwardly from the land 122*a.* Thus, the region of greatest abrading influence on the workpiece 23 is determined by the land 122*a,* which exerts the greatest pressure on abrasive belt 79 over a narrow longitudinal region which is oblique both to the line of movement of the abrasive belt 79 and the workpiece 23.

Operation of the apparatus may be understood by considering the abrading effect on an incremental transverse segment 23*a* of workpiece 23 as it moves through the cross-abrading area. As has been pointed out above, the problem with cross-abrading without platen 122 is that a given abrasive particle on abrasive belt 79 cannot move perpendicularly across the workpiece 23 where the workpiece is moving with any degree of longitudinal velocity. Rather, the abrasive particle engages the workpiece at one side but moves obliquely across the board due to its longitudinal movement. The inclusion of an oblique platen having a narrow land prevents a single abrasive particle from having an abrading effect over the entire width of the board.

With reference to the incremental segment 23*a,* the initial abrading effect is at the extreme left side of the segment where it in effect transects the land 122*a.* Stated otherwise, the abrasive particles overlying the incremental segment 23*a* have a primary effect where the land 122*a* meets the segment 23*a.* Because this region is of small lateral dimension, the resulting effect of the abrasive particles is to create cross-abrading which is generally parallel with the line of abrasive belt movement and generally perpendicular to the line of workpiece movement.

As the incremental segment 23*a* advances longitudinally, the region of platen influence is where the land 122*a* meets the segment 23*a,* and this area is immediately to the right of the initial area of contact. Because this new region of abrasive contact is also narrow, the abrasive effect is similarly limited but generally perpendicular to the line of workpiece movement.

As the incremental segment 23*a* continues to advance longitudinally, the perpendicular abrasive effect continues from left to right until the segment 23 has passed completely through the area of platen influence, at which time it is fully cross-grained. The cross-grained effect is represented by the numeral 23*b* in FIG. 8.

Figure 10:
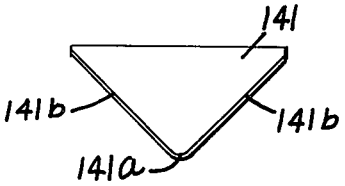
FIGS. 10–12 are alternative embodiments of the platens capable of use with the cross-grain sanding machine.
Figure 12:
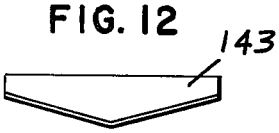

Other platen cross-sectional configurations are capable of performing the necessary function, and three alternative embodiments are shown in FIGS. 10, 12. In FIG. 10, a platen 141 defines a right triangle, the apex 141*a* of which is rounded to define a smooth logitudinal line of contact with the abrasive belt. The sides 141*b* are mutually perpendicular, diverging somewhat more sharply than sides 122*b* of platen 122.

Figure 11:
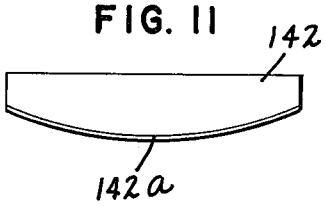

With reference to FIG. 11, a second alternative embodiment of the platen is represented by the numeral 142. Platen 142 has a convex undersurface 142*a* which engages the abrasive belt somewhat tangentially, although the region of contact increases from a line over the length of the platen to a lateral region as the platen engages the belt with increasing force.

FIG. 12 discloses an alternate platen 143 having saide 143*a* similar to sides 122*b,* but converging to a point 143*b.* The region of contact of platen 143 is thus defined by a single line extending over the length of the platen.

Each of the platens 122, 141–143 may be used successfully with the machine in creating a cross-grain, rough-sawn effect. The results will be slightly different for each case, and the platen is chosen to obtain the proper effect on the type of wood or other material used. The essential structural feature of each platen is that it have a longitudinal region of contact with the abrasive belt, the lateral dimension of which is sufficiently narrow to preclude the abrasive effect from becoming oblique rather than parallel to the abrasive belt itself. Although other variables are involved, such as longitudinal speed of the workpiece, speed of the abrasive belt and angle of the platen relative to the belt, I have found that the region of platen contact is of primary significance. I have also found that the laterally small contact region advantageously increases the pressure per unit area of the abrasive belt, in addition to preventing the oblique travel of abrasive particles.

In the preferred embodiment, workpieces 23 pass through the work area at approximately 45 feet per minute, the abrasive belt 79 moves through the work area at approximately 1,500 surface feet per minute, the platen 122 defines an angle of approximately 70° with the line of belt movement, and the land area 122*a* of platen 122 is approximately one quarter of an inch wide.

I claim:

1. Apparatus for creating a rough, cross-sawn effect over the surface of a workpiece of wood or the like having longitudinal and lateral dimensions comprising:

a. means for moving the workpiece through a work area in the direction of said longitudinal dimension;

b. and means for producing a plurality of observable grooves in said workpiece transverse to said longitudinal direction to create said rough, cross-sawn effect, comprising i. endless abrasive belt means movable through said work area transverse to said longitudinal dimension, said abrasive belt means having abrasive grit thereon sized to create said observable grooves;

ii. longitudinal platen means disposed on the opposite side of the endless abrasive belt means from the workpiece for forcing the endless abrasive belt means into engagement with the workpiece;

iii. the platen means having a longitudinal region of contact with the endless abrasive belt means which is disposed obliquely to its line of movement, said contact region having a lateral dimension that is sufficiently narrow to restrict the transverse abrasive engagement of the grit with the workpiece surface to produce grooves that are short relative to the lateral dimension and generally parallel to the line of movement of the endless abrasive belt means, whereby said cross-sawn effect is created.

2. The apparatus defined by claim 1, wherein the grit size of the endless abrasive belt means is in the range of about No. 4 to No. 6.

3. The apparatus defined by claim 1, wherein the endless abrasive belt means and the workpiece moving means are continuously operable.

4. The apparatus defined by claim 1, and further comprising means for resiliently biasing the platen means into operative engagement with the workpiece.

5. The apparatus defined by claim 1, wherein the region of contact comprises a land surface which lies in a plane essentially parallel with the plane of the workpiece.

6. The apparatus defined by claim 3, wherein the land surface is straight over its length.

7. The apparatus defined by claim 3, wherein the platen means comprises longitudinal sides that diverge away from said land surface.

8. The apparatus defined by claim 1, wherein the region of contact comprises a line of contact.

9. The apparatus defined by claim 1, wherein the region of contact comprises a straight line of contact.

10. The apparatus defined by claim 1, wherein the platen means is essentially triangular in cross section, the region of contact being defined by the apex of the triangle extended over the length of the platen means.

11. The apparatus defined by claim 10, wherein the apex of the triangle is rounded.

12. The apparatus defined by claim 11, wherein the triangle is a right triangle, said apex being defined by mutually perpendicular sides of the triangle.

13. The apparatus defined by claim 9, wherein the platen means comprises longitudinal sides that diverge away from said line of contact.

14. The apparatus defined by claim 1, wherein the platen means comprises a longitudinal platen having a contact surface which is convex in cross section, said region of contact being disposed on said convex surface.

15. The apparatus defined by claim 1, wherein the workpiece moving means moves the workpiece essentially perpendicular to movement of the endless abrasive belt means.

16. The apparatus defined by claim 15, wherein the workpiece moving means comprises first and second pluralities of aligned rollers, the first plurality being disposed in alignment and rotatably driven to move the workpiece, each of said second plurality being mounted in opposition to one of the first plurality and spring biased to engageably press the workpiece therebetween.

17. The apparatus defined by claim 1, wherein the platen means is mounted for extended and retracted movement relative to the workpiece, and further comprising:

a. control means for extending and retracting the platen means; and
b. sensing means for sensing the workpiece as it approaches the work area and causing the control means to extend the platen means for working engagement with the workpiece, and for sensing the workpiece as it leaves the work area and causing the control means to retract the platen means.

18. The apparatus defined by claim 17, wherein the control means comprises at least one inflatable air bag disposed on each side of the platen means and in operative engagement therewith, the air bags being selectively inflatable to effect said extended and retracted movement.

19. The apparatus defined by claim 1, and further comprisng backing platen means disposed in general opposition to the first named platen means and on the opposite side of the endless abrasive belt means therefrom so that the workpiece passes between the respective platen means for pressing engagement thereby.

20. The apparatus defined by claim 1, and further comprising spring-loaded foot means disposed generally adjacent the endless abrasive belt means toward the in-feed end of the machine and in the same general operating plane as the endless abrasive belt means, the spring-loaded foot means being constructed and arranged to engageably press and guide the workpiece for proper movement relative to the endless abrasive belt means.

21. Apparatus for creating a rough, cross-sawn effect over the surface of a workpiece of wood or the like having longitudinal and lateral dimensions comprising:

a. means for moving the workpiece through a work area in the direction of said longitudinal dimension;
b. and means for producing a plurality of observable grooves in said workpiece generally perpendicular to said longitudinal direction to create said rough, cross-sawn effect, comprising
   i. endless abrasive belt means movable through said work area generally perpendicular to said longitudinal dimension, said abrasive belt means having abrasive grit thereon sized to create said observable grooves;
   ii. longitudinal platen means disposed on the opposite side of the endless abrasive belt means from the workpiece for forcing the endless abrasive belt means into engagement with the workpiece;
   iii. the platen means being disposed obliquely to the line of movement of the endless abrasive belt means and having a longitudinal region of contact with the endless abrasive belt means that is sufficiently narrow to restrict the lateral abrasive engagement of the grit with the workpiece surface to produce grooves that are short relative to the lateral dimension of the workpiece and generally perpendicular to its line of movement through the work area, whereby said cross-sawn effect is created.

22. The apparatus defined by claim 21, wherein the grit size of the endless abrasive belt means is in the range of about No. 4 to No. 6.

23. A method for creating a rough, cross-sawn effect over the surface of a workpiece of wood or the like having longitudinal and lateral dimensions, comprising:

a. moving the workpiece through a work area in the direction of said longitudinal dimension;
b. and producing a plurality of observable grooves in the workpiece transverse to said longitudinal direction to create said rough, cross-sawn effect, by
   i. moving an endless abrasive belt having abrasive grit thereon sized to create said observable grooves through the work area transversely of said longitudinal dimension;
   ii. and causing engagement of the abrasive belt with the workpiece surface only in a longitudinal contact region which is oblique to the line of movement of the abrasive belt, the contact region being of limited lateral dimension to produce grooves that are short relative to the lateral dimension of the workpiece and generally perpendicular to its line of movement through the work area, whereby said cross-sawn effect is created.

24. The method defined by claim 23, wherein the abrasive belt is caused to engage the workpiece by a longitudinal platen having a narrow land surface which is disposed on the opposite side of the endless abrasive belt from the workpiece.

25. The method defined by claim 23, wherein the grit size of the endless abrasive belt is in the range of about No. 4 to No. 6.

* * * * *

UNITED STATES PATENT AND TRADEMARK OFFICE

CERTIFICATE OF CORRECTION

PATENT NO. : 4,038,784

DATED : August 2, 1977

INVENTOR(S) : Howard W. Grivna

It is certified that error appears in the above-identified patent and that said Letters Patent are hereby corrected as shown below:

Column 2, line 2, "pices" should be changed to --pieces--.

Column 2, lines 57-58, the phrase "extension of the this example" should be changed to --extension of this example--.

Column 3, line 1, "workpiees" should be changed to --workpieces--.

Column 3, line 20, "section" should be changed to --sectional--.

Column 3, lines 64-65, "adjscent" should be changed to --adjacent--.

Column 8, line 7, "wupward" should be changed to --upward--.

Column 9, line 46, "logitudinal" should be changed to --longitudinal--.

Column 9, line 57, "saide" should be changed to --sides--.

UNITED STATES PATENT OFFICE
CERTIFICATE OF CORRECTION

Patent No. 4,038,784 Dated August 2, 1977

Inventor(s) Howard W. Grivna

It is certified that error appears in the above-identified patent and that said Letters Patent are hereby corrected as shown below:

Column 11, line 48, "comprisng" should be -- comprising --.

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*